US009567131B2

(12) United States Patent
Riva

(10) Patent No.: US 9,567,131 B2
(45) Date of Patent: Feb. 14, 2017

(54) CONTAINERS WITH POURING SPOUT

(71) Applicant: TACOM S.A., Magliaso (CH)

(72) Inventor: Francesco Riva, Vernate (CH)

(73) Assignee: TACOM S.A., Magliaso (CH)

( * ) Notice: Subject to any disclaimer, the term of this patent is extended or adjusted under 35 U.S.C. 154(b) by 0 days.

(21) Appl. No.: 14/909,142

(22) PCT Filed: Aug. 1, 2014

(86) PCT No.: PCT/IB2014/063611

§ 371 (c)(1),
(2) Date: Feb. 1, 2016

(87) PCT Pub. No.: WO2015/015460

PCT Pub. Date: Feb. 5, 2015

(65) Prior Publication Data

US 2016/0167830 A1 Jun. 16, 2016

(30) Foreign Application Priority Data

Aug. 2, 2013 (IT) ..... TO2013A0666

(51) Int. Cl.

| | |
|---|---|
| ***B65D 5/74*** | (2006.01) |
| ***B65D 5/76*** | (2006.01) |
| ***B65D 83/06*** | (2006.01) |
| ***A47G 19/24*** | (2006.01) |

(52) U.S. Cl.

CPC ..... *B65D 5/744* (2013.01); *A47G 19/24* (2013.01); *B65D 5/76* (2013.01); *B65D 83/06* (2013.01)

(58) Field of Classification Search

CPC ..... B65D 5/744; B65D 5/76; B65D 83/06; A47G 19/24

USPC ..... 229/215; 222/528, 529, 556, 557, 560

See application file for complete search history.

(56) References Cited

U.S. PATENT DOCUMENTS

| | | | | |
|---|---|---|---|---|
| 1,746,006 | A * | 2/1930 | Metzger | A47G 19/24 229/234 |
| 2,288,549 | A | 6/1942 | Ramsden et al. | |
| 3,202,336 | A | 8/1965 | Bord | |
| 3,568,910 | A * | 3/1971 | McConnell | B65D 5/744 229/125.42 |
| 4,194,677 | A * | 3/1980 | Wysocki | B65D 5/744 222/528 |
| 5,597,115 | A * | 1/1997 | Reo | B65D 5/541 229/125.42 |
| 5,678,755 | A * | 10/1997 | Block | B65D 5/744 229/215 |
| 6,227,440 | B1 | 5/2001 | Hart | |
| 2004/0173670 | A1 * | 9/2004 | Snyder | B65D 5/744 229/215 |
| 2006/0000880 | A1 * | 1/2006 | Wein | B65D 5/744 229/215 |

FOREIGN PATENT DOCUMENTS

FR 2787766 A1 6/2000

* cited by examiner

*Primary Examiner* — Gary Elkins
(74) *Attorney, Agent, or Firm* — Robert E. Alderson, Jr.

(57) ABSTRACT

Containers are provided which provide controlled dispensing for items such as saltshakers. Such containers can be produced in a simple and economical manner and can be adapted to different types of products, such as different types of salt. Such containers are particularly useful for dispensing fine salt.

6 Claims, 5 Drawing Sheets

CONTAINERS WITH POURING SPOUT

CROSS-REFERENCE TO RELATED APPLICATIONS

This application is a National Phase Application of PCT International Application No. PCT/IB2014/063611, International Filing Date, Aug. 1, 2014, claiming priority to Italian Patent Application No. TO2013A000666 (102013902181716), filed Aug. 2, 2013, each of which is hereby incorporated by reference in its entirety.

FIELD OF THE INVENTION

The present invention relates to a container for pouring products in granule or powder form, particularly a saltshaker, provided with a pouring spout.

BACKGROUND OF THE INVENTION

It is known that containers, mostly made of cardboard and having a substantially parallelepipedal shape, provided with pouring spouts are commonly used for pouring various kinds of products in granule or powder form, such as salt, sugar and soluble food products. These spouts are made of metallic material (aluminium), plastic material or cardboard, and are fixed to a pivotable tab formed in a wall of the container, possibly by making a cut in this wall in the shape of an inverted U, the tab being fixed to a central portion of the spout. The pouring spout is inserted in the pouring opening and is movable between a retracted, closed position and an extracted position in which it is possible to pour a certain quantity of a product contained in the container.

Recently it has been proposed that pouring spouts should also be applied to saltshakers for containing fine table salt. These containers, generally of cylindrical shape and made of plastic material, have two pouring openings, namely a first opening for pouring the salt in bulk and a second opening for sprinkling a controlled portion of salt. This second pouring opening has a dispensing spout associated with a perforated wall that covers the pouring opening and allows the salt to pass out through the circular perforations only.

Saltshakers of the aforesaid type are limited in that a certain diameter of the perforations generally provides good controlled dispensing of salt having a specific degree of fineness, but the perforations impede the pouring of the salt if it has a coarser particle size, or allow too much salt to pass out if the salt has a finer particle size. Since salt is hygroscopic, the perforations easily tend to become occluded when moisture is present, especially in the case of salt which is not very fine. It would therefore be necessary to provide different types of saltshaker, having walls with perforations whose diameters are differentiated according to the degree of fineness of the salt contained.

SUMMARY OF THE INVENTION

A general object of the present invention is to provide a container which facilitates controlled dispensing. More particularly, an object of the invention is to produce, in a simple and economical way, a container which can be used to pour a measured and controlled quantity of a content in powder or similar form, for example foodstuffs or loose detergents, and to prevent the accidental pouring of excessive quantities.

This object is achieved according to the invention with containers having the features described and claimed herein.

Briefly, the container comprises a casing which has a pouring opening in which a pouring spout is inserted. The pouring opening is formed in an outer wall of the casing. The casing comprises an inner wall which is juxtaposed to the outer wall and forms a cutout at least partially aligned with the pouring opening. Thus a first part of the pouring opening is occluded by a portion of the inner wall, while a second part of the pouring opening, complementary to the first part, creates with the cutout a single passage for pouring the contents of the casing. The casing is formed by bending a single shaped sheet which forms in a single piece all the walls or flaps constituting the casing. The pouring opening is formed by a cut made in a first peripheral flap of the shaped sheet. The same sheet has a second peripheral flap, located on a side or end of the sheet opposite the side having the first peripheral flap. The cutout in the inner wall is formed in the second peripheral flap.

Because of this arrangement, the cutout can be prepared and adapted in a relatively simple way by the container manufacturer, in such a way that the inner wall forms, together with the outer wall, a pouring passage which can be adapted to different types of salt with minimal modification, and without the disadvantages of the prior art.

A few non-limiting embodiments of the invention will now be described, with reference to the attached drawings.

DETAILED DESCRIPTION

Figure 1:
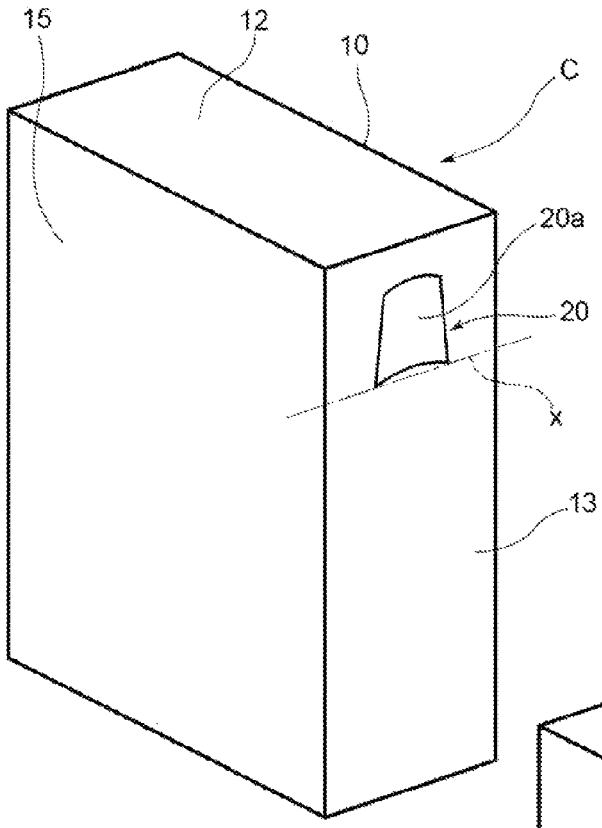
FIG. 1 is a schematic perspective view of a container according to a first embodiment, with a pouring spout in a closed position.

With initial reference to FIGS. 1 to 7, the letter C indicates the whole of a container, particularly a saltshaker. In the remainder of the present description, the container C is defined as a saltshaker, on the understanding that the container may be used to pour any product in granule, powder or flake form, not necessarily salt, although the invention was primarily devised for the purpose of sprinkling fine salt. For example, the container may be used to pour various kinds of product in granule or powder form, such as salt, sugar, detergents, and others.

The container C comprises a boxlike casing 10, preferably having a generally parallelepipedal shape, and a pouring spout 20.

Advantageously, but not necessarily, the casing 10 is made of cardboard. More generally, the casing may be made of a sheet material having a semi-rigid consistency, typically cardboard, pasteboard, polylaminate such as Tetra Pak, or the like.

In the examples illustrated here, the casing (or box) 10 has a horizontal lower rectangular bottom or base 11 (FIG. 4), a horizontal upper rectangular base 12, and four vertical outer lateral walls 13, 14, 15, 16, two of which (13 and 14) are narrower than the others.

An opening 17 is formed in the upper part of the narrow outer wall 13. The pouring spout 20 is inserted into the opening 17. The opening 17 may be formed by making a cut 22, substantially in the shape of an inverted U with two substantially vertical branches 21, in an outer vertical wall 13. The cut 22 forms a tab 23 which, by swinging outwards about a horizontal transverse line of articulation x, opens the opening 17. As used here, the terms "transverse", "longitudinal" and "lateral" should be interpreted with reference to the axis x, unless noted otherwise. Terms such as "inner" and "outer" relate to the inside and the outside of the container.

Figure 3:
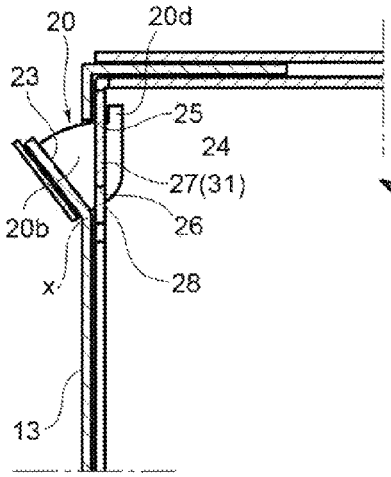
FIG. 3 is a partial view in vertical section of the container of FIG. 2 with the pouring spout in a fully open position.

The design of the pouring spout may vary from the example illustrated here. The general configuration and the opening and closing operation of a pouring spout are considered to be generally known. In the present example, the spout 20 forms a central portion 20*a*, which is the part attached to the tab 23, and two lateral wings 20*b*, 20*c* bent along respective bending lines 20*b*', 20*c*' along which they are joined to the central portion 20*a*. In the upper part, on the lateral edges of the wings 20*b*, 20*c*, there are formed two identical protuberances 20*d* which act as stop elements; the protuberances 20*d* are adapted to bear against an inner surface 24 of the container to determine the maximum opening position of the spout, as shown in FIG. 3.

The pouring spout 20 is movable between a retracted, closed position (FIG. 1) and an extracted, open position (FIG. 2) for pouring a certain quantity of a product in granule, powder or flake form, in this example salt, contained inside the casing.

The casing 10 comprises an inner wall 25 which is juxtaposed to the outer wall 13 in the assembled condition. The inner wall 25 has a cutout 26 which is at least partially aligned with the opening 17 formed by the outer wall 13.

Figure 2:
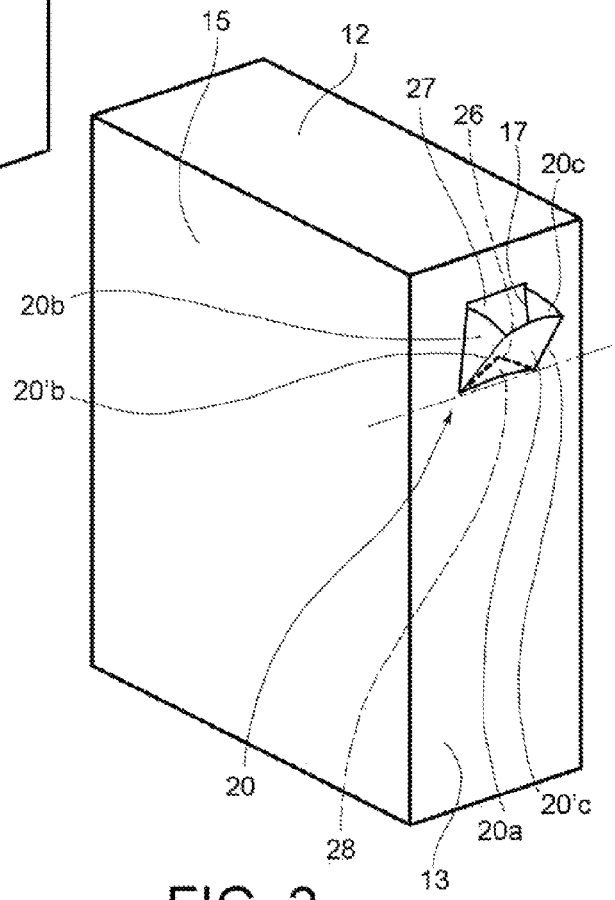
FIG. 2 is a perspective view of the container of FIG. 1 with the pouring spout in a fully open position.

As shown in FIG. 2, when the spout is in the extracted or open position, a first part of the opening 17 is occluded by a portion 27 of the inner wall 25, while a second part of the opening 17, complementary to the first part, creates with the cutout a single passage 28 which extends through the casing. The passage created by the partial alignment of the opening 17 with the cutout 26 has a smaller area than that of the opening 17. In other words, the inner wall 25 partializes the opening 17. This reduction or partialization is configured in such a way that the resulting passage 28 allows fine salt to be poured in a controlled way.

By way of illustration, the area of the passage 28 created by the alignment of the cutout 26 and the opening 17 may range from a minimum of a few $mm^2$ to a maximum of about 40 $mm^2$, depending on the size of the granules of the product to be poured.

Figure 4:
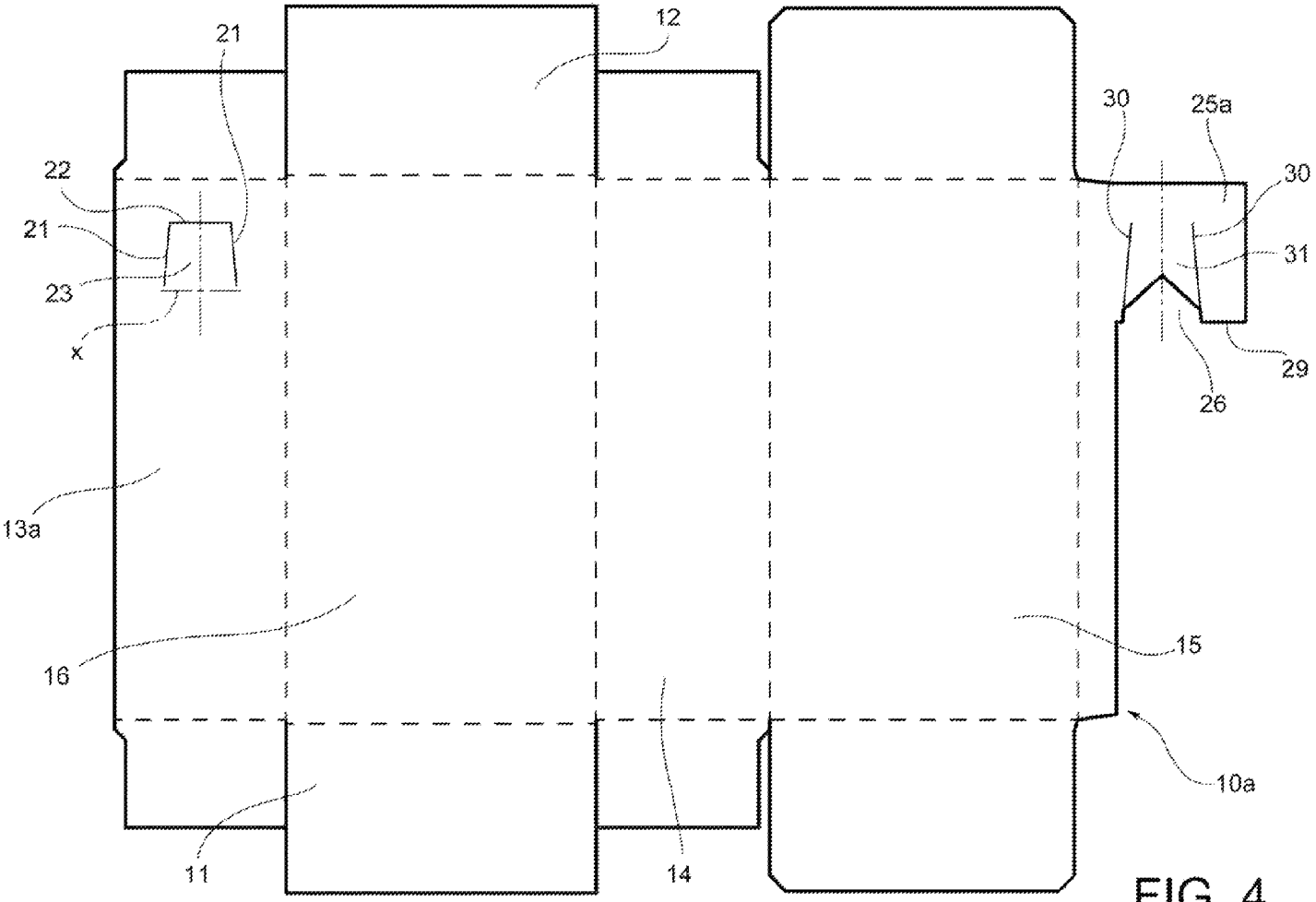
FIG. 4 shows a flat shaped sheet from which the casing of FIGS. 1 and 2 can be formed by bending and gluing.

The casing 10 can be formed by bending a single shaped sheet 10*a* which forms in a single piece all the walls or flaps constituting the casing, as is shown, for example, in the flattened configuration of FIG. 4.

In the embodiment of FIG. 4, the cut 22 forming the opening 17 is made in a first peripheral flap 13*a* of the sheet 10*a*, which has a second peripheral flap 25*a* located on a side or end of the sheet 10*a* opposite to the side having the first peripheral flap 13*a*. The cutout 26 is formed in the second peripheral flap 25*a*.

Figure 6:
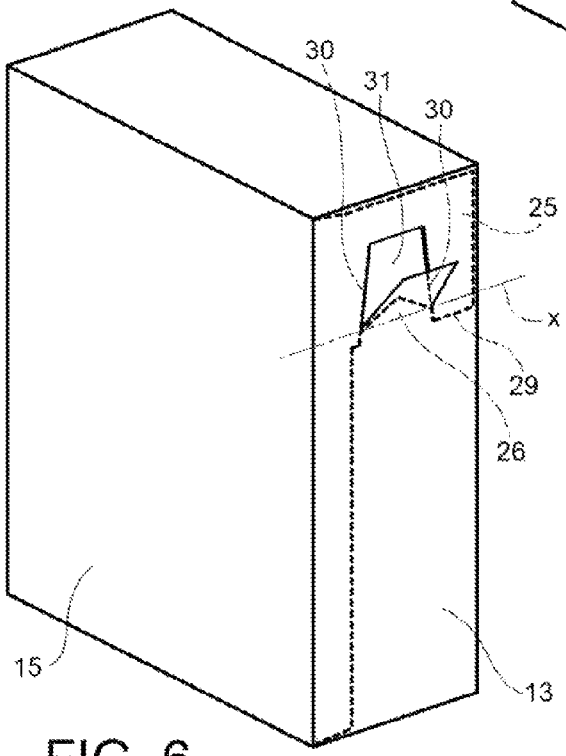
FIG. 6 is a perspective view which schematically illustrates the container of FIG. 1, with some parts removed for illustrative purposes.

In the assembled, three-dimensional condition, the second flap 25*a* forms the inner wall 25, and is superimposed internally on the first flap 13*a*, which forms the outer vertical wall 13. FIG. 6 shows schematically the position of the inner wall 25 behind the outer wall 13; for illustrative purposes, the pouring spout 20 and the cutout 22 in the outer part 13 are omitted from FIG. 6. The position of the line of articulation x of the outer tab 23 is shown.

Forming all the flaps and walls of the container from a single sheet is particularly advantageous in terms of cost and speed of production.

In an alternative embodiment (not shown), the inner wall 25 may be composed of a flap formed by a separate sheet, joined, by adhesive for example, to the sheet that forms the outer wall 13.

In one embodiment, the flap 13*a* forming the cutout 26 has a lower free edge 29 and a pair of cuts 30 which extend upwards from the lower edge 29, so as to form an inner tab 31 that can be superimposed on the outer tab 23. In this embodiment, the portion 27 of the inner wall 25 serving to partialize the pouring passage 28 is formed by the inner tab 31.

The cuts 30 can be superimposed internally on the branches 21 of the inverted U-shaped cut 22 so as to allow each of the wings 20*b*, 20*c* of the spout to be inserted through the outer wall 13 and inner wall 25. The protuberances 20*d* of the spout bear against the inner wall 25 in the maximum opening position of the spout, as shown in FIG. 3.

In the embodiment of FIG. 4, the cutout 26 extends upwards in the inner tab 31 from the lower edge 29, in an intermediate position between the cuts 30.

Figure 5:
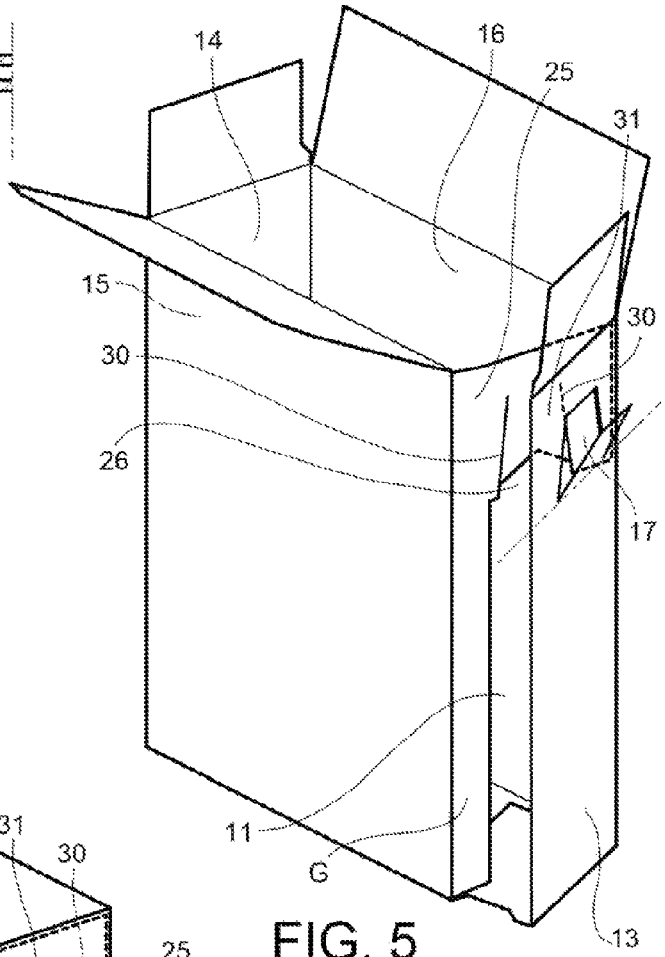
FIG. 5 is a perspective view showing the container of FIGS. 1 and 4 in a partly assembled condition.

In the example shown in FIGS. 2, 4 and 5, the cutout 26 is shaped as a cutout of inverted V shape. This shape is not to be considered as limiting. Other shapes, for example round or polygonal (e.g. rectangular or trapezoid) shapes may also be suitable for this purpose.

In order to fix the three-dimensional shape of the container, a quantity of adhesive may be applied to the interface G between the inner wall 25 and the outer wall 13 (FIG. 5).

In the mounted or three-dimensional condition (FIG. 2), an upper portion of the cutout 26 projects above the horizontal line of articulation x of the tab 23. The alignment or superimposition of the upper part of the cutout 26 and the opening 17 defines the restricted pouring passage 28.

When the spout is in the position of maximum extraction (FIGS. 2 and 3), the salt or other loose content flows out of the pouring passage in a controlled way, so as to be sprinkled on to food.

Figure 7:
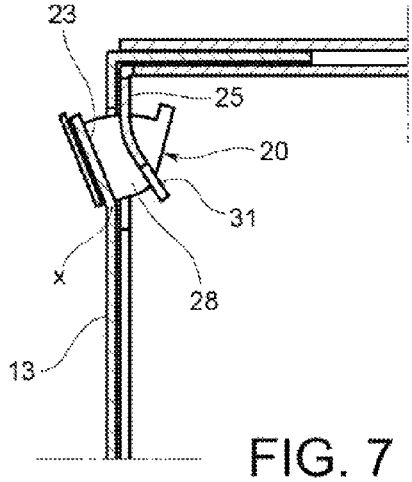
FIG. 7 is a partial view in vertical section, similar to that of FIG. 3, with the pouring spout in a partly open position.

The embodiment of FIGS. 1 to 7 also allows the salt (or other contents) to be poured in rather larger doses. This pouring mode can be provided when the pouring spout is not fully extracted. The inner tab has a certain freedom to swing, being attached only at its top to the rest of the container. From the position of maximum extraction (FIG. 3), the spout can be pushed back towards the closed position, but with the pushing movement halted midway (FIG. 7). When the spout moves towards the closed position, the wings of the spout bear with a certain amount of friction on the sides of the inner tab, thus moving it to a small but perceptible degree towards the inside of the container. In this position, therefore, there is a larger gap between the inner tab and the surface of the spout facing the inner tab. In this position, the salt is not dispensed solely through the cutout 26, but through a wider passage 28, defined between the lower edge of the inner tab 31, the cutout 26, and the line of articulation x of the outer tab 23.

Figure 8:
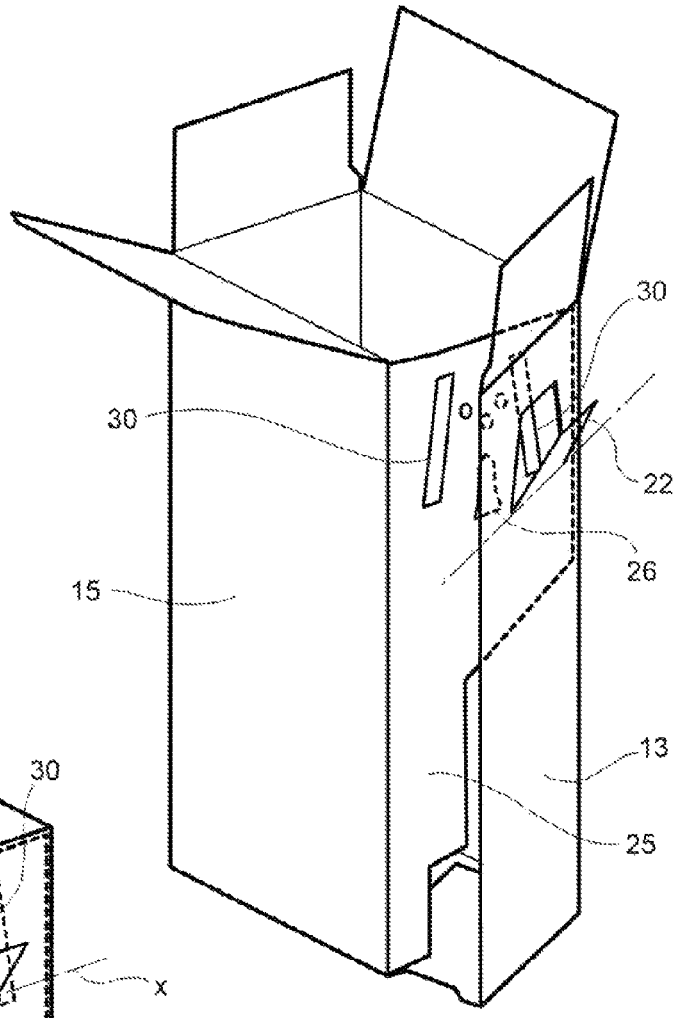
FIG. 8 is a perspective view showing a container according to a second embodiment, in a partly assembled condition.
Figure 9:
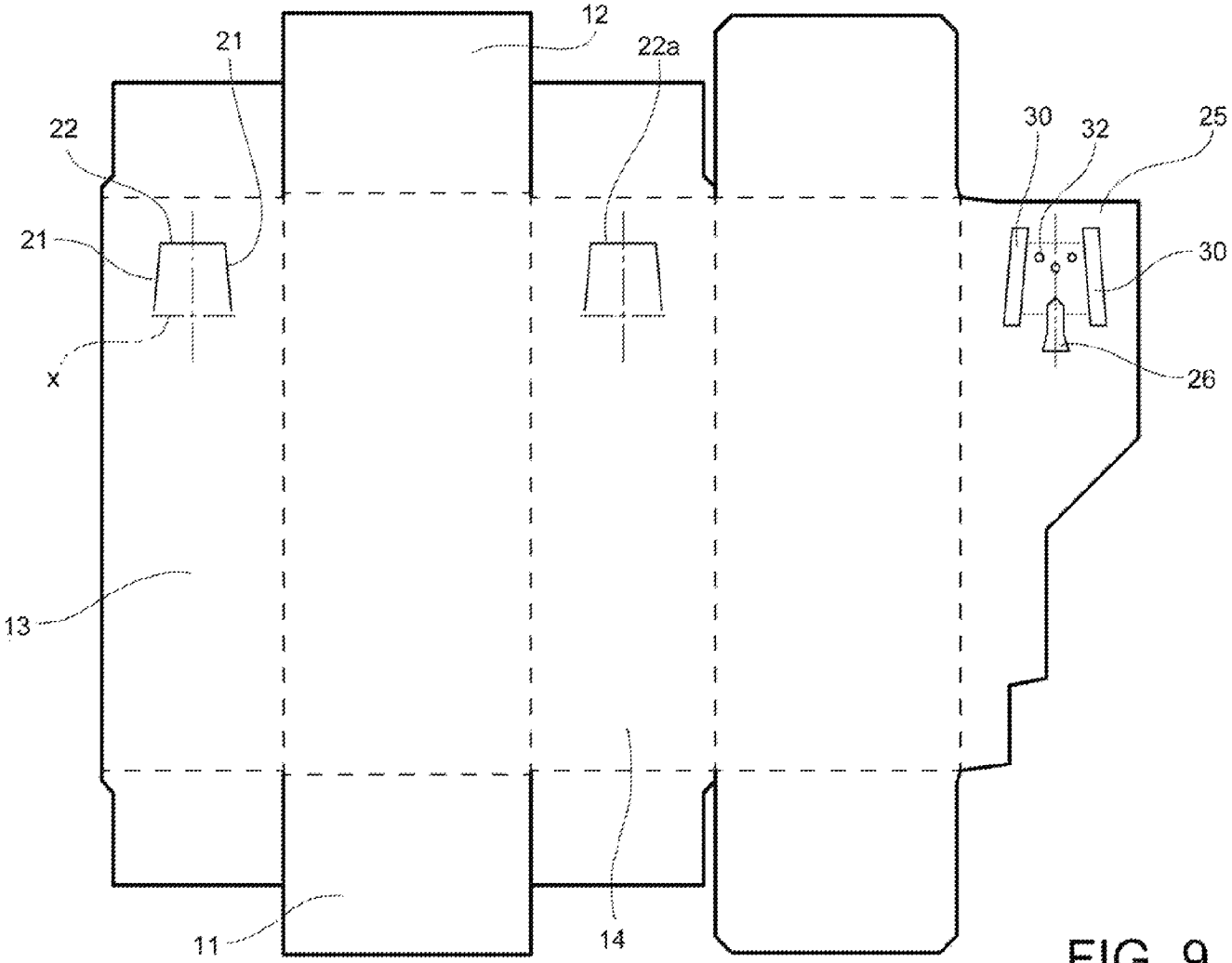
FIG. 9 shows a flat shaped sheet from which the casing of FIG. 8 can be formed by bending and gluing.

In the embodiment shown in FIGS. 8 and 9, the cutout 26 is formed as a through hole delimited by a closed line through the inner wall 25. Two cuts 30 are also made in the wall 25, these cuts being adapted to be superimposed internally on the branches 38 of the inverted U-shaped cuts so as to allow each of the wings of the spout to be inserted through the outer wall 13 and inner wall 25. In this embodiment also, the protuberances 20*d* of the spout bear against the inner wall 25 in the maximum opening position of the spout. In this embodiment, the absence of a movable inner tab does not allow a more generous dispensing configuration to be provided, whereas this is possible in the example of FIGS. 1 to 7. Therefore, with a container such as that of FIGS. 8 and 9, it may be appropriate to provide a second cut 22*a* in the container (FIG. 9) to form a second pouring opening shaped to allow pouring in more generous doses. This second pouring opening is entirely conventional, and therefore it has no inner wall adjacent to it for the purposes of partialization.

In one embodiment, the cutout 26, in the shape of a hole, as shown for example in FIGS. 8 and 9, may be formed in such a way and in such a size that only a top part (or active part) of the cutout is aligned with or juxtaposed to the pouring opening, by projecting above the line of articulation x of the opening 17. A lower (non-active) part of the cutout 26 is occluded by the outer wall 13. Thus a hole which is not excessively small can be made by punching, and only a part of this hole can be used for dispensing the salt. In the paper and card industry, the forming of circular holes with diameters of 2-4 mm by punching gives rise to problems.

Figure 10:
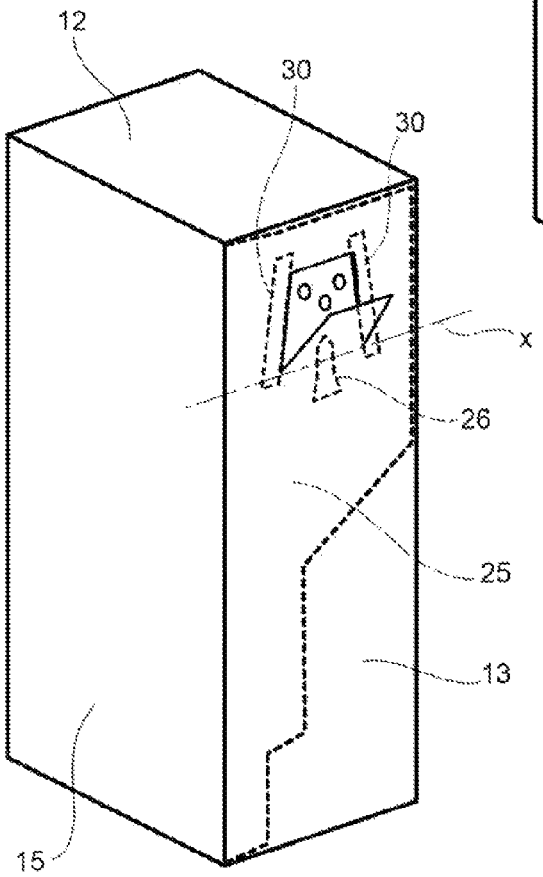
FIG. 10 is a perspective view which schematically illustrates the container of FIG. 8, with some parts removed for illustrative purposes.

As shown schematically in FIG. 10, most of the cutout 26 is not used for dispensing salt, since it is occluded by the outer wall 13. The cutout 26 is conveniently formed with a punch or blades whose sizes are not excessively small. FIG. 10 shows schematically the position of the inner wall 25 behind the outer wall 13; for illustrative purposes, the pouring spout 20 and the cutout 22 in the outer part 13 are omitted from FIG. 10. The position of the line of articulation x of the outer tab 23 is shown.

In order to make the controlled pouring opening 17 more readily distinguishable from the uncontrolled pouring opening provided by the cut 22*a*, part of the inner wall 25 located between the cuts 30 may be decorated with images of small holes 32 (FIG. 9) which give the user an immediate impression of the holes in a saltshaker.

As will be appreciated, the container can be produced relatively easily by a manufacturer of cardboard blanks. A given cutout may serve for the controlled dispensing of various types of granular material; if it is desired to adapt the container to a product having a different particle size, this may be done without any particular added costs, as it will simply be necessary to use a smaller or larger punch; alternatively, if the same punch is used to stamp out the hole 26, this punch can advantageously be moved to a higher or lower position, respectively, to increase or reduce the area created by the superimposition or juxtaposition of the cutout 26 relative to the opening 17 in the outer wall of the container. No appreciable changes are required in the production lines.

Various aspects and embodiments of the container have been described. It is to be understood that each embodiment can be combined with any other embodiment. Furthermore, the invention is not limited to the embodiments described, but may be modified within the scope of protection claimed herein.

The invention claimed is:

1. A container comprising:

a casing with at least an outer wall having at least one pouring opening;

a pouring spout inserted in the pouring opening, the spout being movable between a retracted, closed position and an extracted position for pouring a certain quantity of a product in granule, powder or flake form, contained inside the casing; and the casing comprising an inner wall, juxtaposed to the outer wall, wherein an inner wall forms a cutout at least partially aligned with the pouring opening, whereby a first part of the pouring opening is occluded by a portion of the inner wall, and a second part of the pouring opening, complementary to the first part, creates with the cutout a single passage for pouring the contents of the casing, wherein the casing is formed by bending a single shaped sheet which forms in a single piece all the walls or flaps of the casing;

wherein the pouring opening is formed by a cut made in a first peripheral flap of the shaped sheet, and wherein the shaped sheet has a second peripheral flap located on its side or end opposite to the side having the first peripheral flap, wherein the cutout is formed in the second peripheral flap.

2. The container of claim 1, wherein the inner wall provides an edge and the cutout extends in the inner wall from the edge.

3. The container of claim 2, wherein the cut forming the opening in the outer wall has substantially the shape of an inverted U with two substantially parallel branches, the cut creating an outer tab pivotable outwards about a line of articulation (x), wherein the inner wall comprises a pair of cuts which extend upwards from the lower edge so as to form an inner tab, and the cuts are substantially aligned or juxtaposed to branches of the cut in the outer wall.

4. The container of claim 1, wherein the cutout is formed as a through hole delimited by a closed line through the inner wall.

5. The container of claim 1, wherein an upper portion of the cutout protrudes above a line of articulation (x) of the outer tab, whereby the alignment or superimposition of the upper part of the cutout and the opening defines the pouring passage.

6. The container of claim 1, wherein the passage has an area in a range from about 1 $mm^2$ to about 40 $mm^2$.

* * * * *